United States Patent [19]

Volbeda

[11] 4,327,507

[45] May 4, 1982

[54] ROTARY CUTTER HEAD WITH JET FLUSHING BLADES

[75] Inventor: Johan H. Volbeda, Leidschendam, Netherlands

[73] Assignee: Hollandsche Aanneming Maatschappij B.V., Rijswijk, Netherlands

[21] Appl. No.: 154,177

[22] Filed: May 28, 1980

[30] Foreign Application Priority Data

May 28, 1979 [NL] Netherlands ..... 7904177

[51] Int. Cl.[3] ..... E02F 3/88

[52] U.S. Cl. ..... 37/67; 37/63; 175/67; 299/81

[58] Field of Search ..... 37/62, 63, 64, 65, 67; 299/81; 175/67

[56] References Cited

U.S. PATENT DOCUMENTS

| | | | |
|---|---|---|---|
| 725,817 | 4/1903 | Bates | 37/67 |
| 725,818 | 4/1903 | Bates | 37/67 X |
| 3,563,324 | 2/1971 | Lauber | 299/81 X |
| 3,688,511 | 9/1972 | Harmstrof | 37/62 X |
| 3,747,982 | 7/1973 | Agnew et al. | 299/81 |
| 4,004,358 | 1/1977 | Van Os | 37/63 |

FOREIGN PATENT DOCUMENTS

| | | | |
|---|---|---|---|
| 1399802 | 7/1975 | United Kingdom | 37/65 |
| 224379 | 11/1968 | U.S.S.R. | 37/67 |
| 610993 | 6/1978 | U.S.S.R. | 299/81 |

*Primary Examiner*—Clifford D. Crowder
*Attorney, Agent, or Firm*—Sughrue, Mion, Zinn, Macpeak and Seas

[57] ABSTRACT

A cutter having a plurality of cutting blades for a suction-dredger which in operation is driven into rotation so that said cutting blades are capable to cut loose the soil which, mixed with water is subsequently sucked up by means of suction tube, one or more nozzles being provided on each cutting blade, at the back of its cutting edge so that the fluid jet ejected from the nozzles of a cutting blade pretreats the soil portion to be cut loose by the next cutting blade.

2 Claims, 5 Drawing Figures

ROTARY CUTTER HEAD WITH JET FLUSHING BLADES

The invention relates to a cutter having a plurality of cutting blades for a suction-dredger which in operation is driven in rotation so that said cutting blades cut loose the soil which, mixed with water, is subsequently sucked up by means of a suction tube, one or more nozzles being provided for ejecting fluid jets against and into the soil layer to be cut loose. Such cutter is known from the Dutch Patent Application No. 74,08623.

The fluid is introduced into the soil in order to reduce the cutting forces that are needed for the cutting of the soil.

In the known cutter the nozzle is formed at the end of the hollow driving shaft of the cutter or at the ends of two separate pipes which extend on both sides of the cutter parallel to the driving shaft.

By this arrangement each fluid jet ejected through a nozzle has to pass over a relatively great distance through the ambient water before it strikes against the soil, so that at that moment the jet has lost a great deal of its impetus and will not be capable to break solid e.g. clayey soils. Therefore this arrangement is only suitable for sandy soils of which the pores are filled with water.

The object of the invention is to provide a cutter in which the nozzles are arranged so that the fluid jets ejected from the nozzles will also be capable to cut loose or fragment solid clayey soils.

This object is achieved by the cutter in accordance with the invention, in which on each cutting blade, at the back of its cutting edge one or more outwardly directed nozzles are provided, so that the fluid jet ejected from the nozzles of a cutting blade pretreats the soil portion to be cut loose by the next cutting blade.

In this way the portion of the soil to be cut loose by a cutting blade is either fluidized (when it has a comparatively high sand content) or cut into pieces (when it has a high clay content) so that the fluid is present in every place where deformations in the soil occur as a result of the cutting action. In addition, the mixing of soil and water will be advanced.

The nozzles are advantageously in communication with channels which extend through or along the cutter blades, at least one closed chamber in the form of a circular arc being provided in which opens a stationary pipe for the supply of the fluid under pressure and of which one wall is formed by the end face of a rotatable, substantially annular member to which the cutting blades are connected and through which extend the ends of the channels, so that during rotation of the cutter said channels are permitted to communicate with said chamber.

Due to the fact that the chamber is constructed in the form of a circular arc it is achieved that during rotation of the cutter a fluid is ejected only through those nozzles which are directed towards the soil and not through the remaining nozzles so that the full fluid pressure can be used for the cutting and/or fluidization of the soil and the formation of said mixture will not be disturbed.

When cutter dredgers are in operation, the cutter head is also swung laterally back and forth first in one direction and then the other. In the one direction of the swinging motion the cutter head rotates in the same direction in the soil being cut, and in the other direction of the swinging motion the cutter head rotates in an opposite direction relative; this means that when the direction of swinging motion is changed fluid should be supplied to the nozzles at another region.

For this reason, preferably two or more chambers in the form of a circular arc are provided which chambers can be communicated individually with the fluid supply tube.

In U.S. Pat. No. 4,004,358 a fluid is introduced into the soil only at the region where during the cutting action of the blade a shear plane is being formed, a shear plane being the plane along which during the cutting action the soil is loosened from the soil still untouched. The fluid is introduced into the soil by means of oblique, perforated tubes extending in the direction of the shear plane and penetrating into the ground.

However it was found that the formation of the shear planes depends on many parameters, as a consequence of which the shape and the location of the shear planes vary to a great extent. As a result, the introduction of a fluid into a specific plane will hardly reduce the cutting forces and, in the case of soil with a high clay content, this does not occur at all. Furthermore this arrangement having perforated tubes is highly impractible and vulnerable since the soil contains often boulders and scrap which will damage the tubes.

The invention will now be described in more detail with reference to the drawing, wherein.

Figure 1:
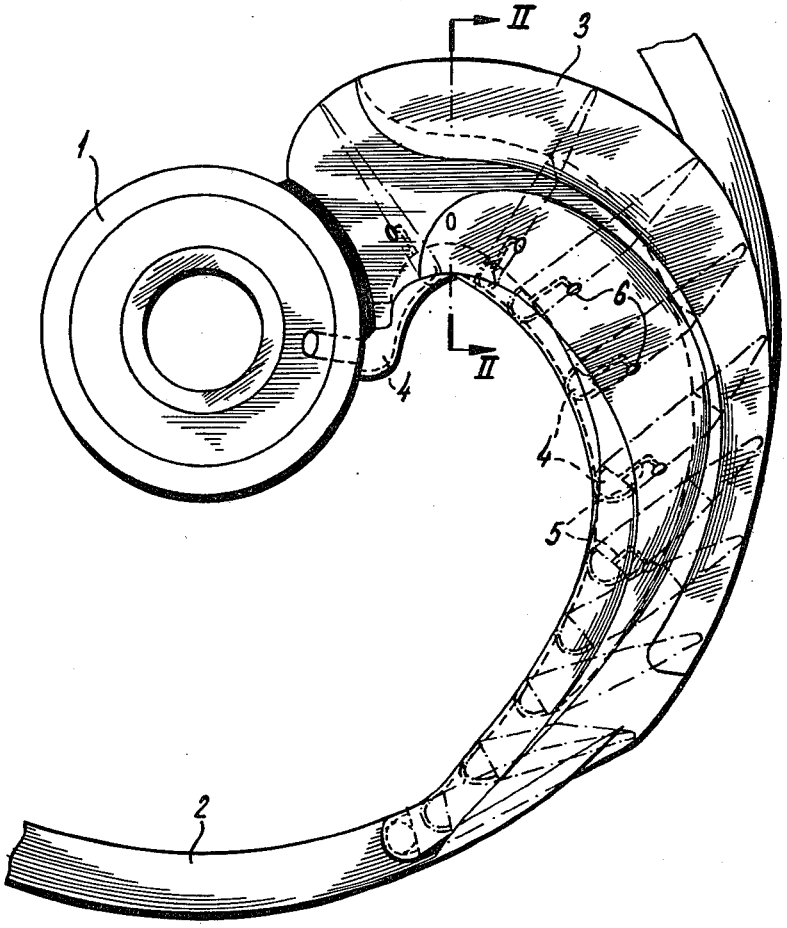
FIG. 1 is a front view of part of the cutter in accordance with the invention.
Figure 2:
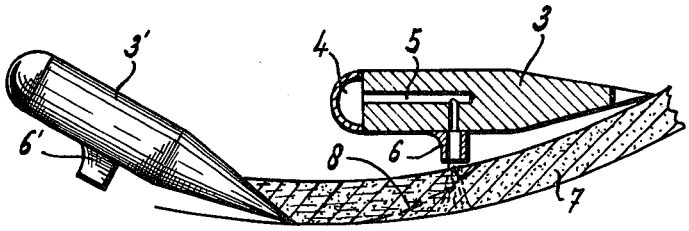
FIG. 2 is a sectional view taken on line II—II of FIG. 1.

As shown in FIGS. 1 and 2, the cutter comprises a rotatable hub 1, a rotatable ring 2, and a number of helical cutter blades 3, one of which being illustrated, which are secured to the hub 1 at their one side and to ring 2 at their other side.

A channel 4 extends through each cutter blade, which channel is closed at the side of the ring and opens at the side of the hub (FIG. 5) so that from this place a fluid under pressure can enter into channel 4. However it is also possible that channel 4 is closed at the side of the hub 1 and opens at the side of the ring 2 (FIG. 3).

From channel 4 a plurality of spaced apart connecting passages 5 are drilled out in each cutting blade, said passages connecting channel 4 with nozzles 6. The spacings may correspond with the distances between the teeth or with portions thereof, as in the case of a cutter, of which the blades are provided with teeth instead of with a continuous cutting edge, as illustrated in the drawing.

As illustrated in FIG. 2 the nozzles 6 project outwardly so that during rotation of the cutter a portion of the soil 7 to be dredged is being fluidized and/or cut into pieces by the fluid jets discharged from the nozzles 6. As a result, each cutter blade, e.g. cutter blade 3' will cut off a fluidized or fragmented portion of the soil, which is defined by the broken line 8. In this way, the requisite cutting forces are considerably reduced.

Figure 3:
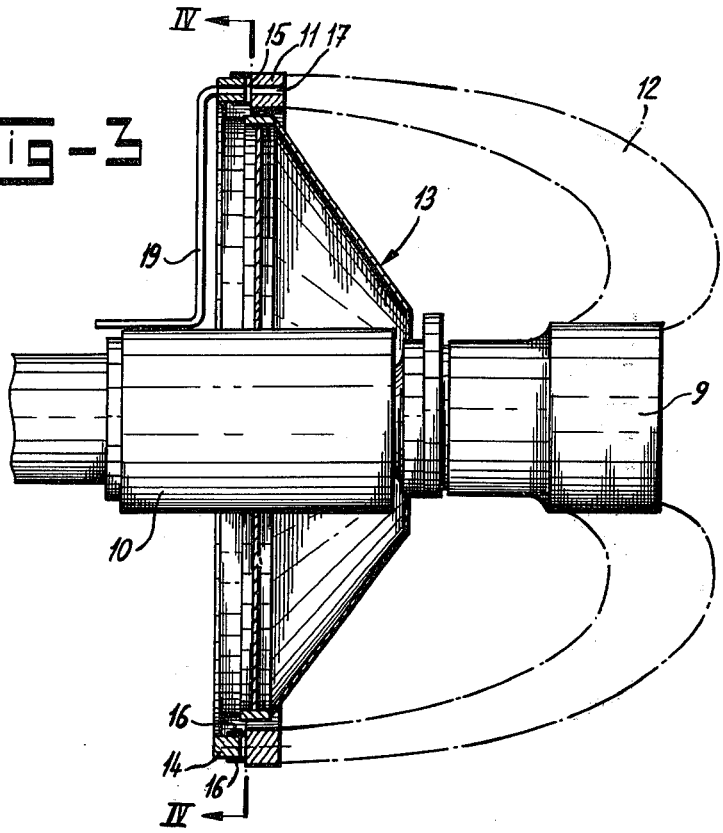
FIG. 3 is a diagrammatic side view of a cutter head in accordance with the invention, and showing the chambers for the supply of a fluid.
Figure 4:
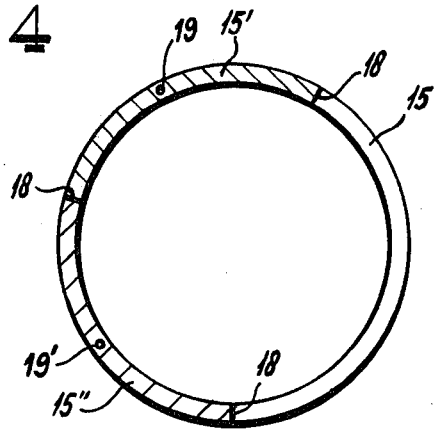
FIG. 4 is a sectional view taken on line IV—IV of FIG. 3.

The cutter illustrated in FIGS. 3 and 4 comprises a hub 9 which is fixed to the end of driving shaft journaled in a bearing 10, and a ring 11. The cutting blades 12, which are only schematically shown, are identical to those illustrated in FIGS. 1 and 2.

In addition the cutter comprises a shield construction 13 which is secured to the bearing 10, a distribution ring 14 being mounted on said shield construction. An annular chamber 15 is formed between the distribution ring 14 and ring 11, said chamber being also defined by the packings 16. The tubes extending through the cutter blades 12 and being indicated in FIGS. 1 and 2 by reference numeral 4 are closed on the side of the hub 9. Said tubes extend through ring 11 (illustrated by reference numeral 17) so that they open in chamber 15. As shown in FIG. 4, the chamber 15 is divided by sealing members 18 into three sections, of which the sections 15' and 15" can be brought individually into communication with pipe 19 for introducing a fluid under pressure into the respective chamber sections 15' and 15". Thus, during rotation of the blades 12, the fluid under pressure will flow to nozzles disposed on the cutter blades only through those channels 17 which move past chamber section 15' or 15" which are in communication with pipe 19, the one chamber section 15' and the other chamber section 15" being in a position such that the cutter blades moving past said chamber sections are the ones which perform the actual cutting action when the cutter swings in the one direction and the other direction respectively. By means of a valve system (not illustrated) the communication of pipe 19 with the chamber sections can be changed from the one chamber section to the other. Said system may be operated by the direction of rotation of the hauling winches, i.e. by the winches which make the cutter swing.

Figure 5:
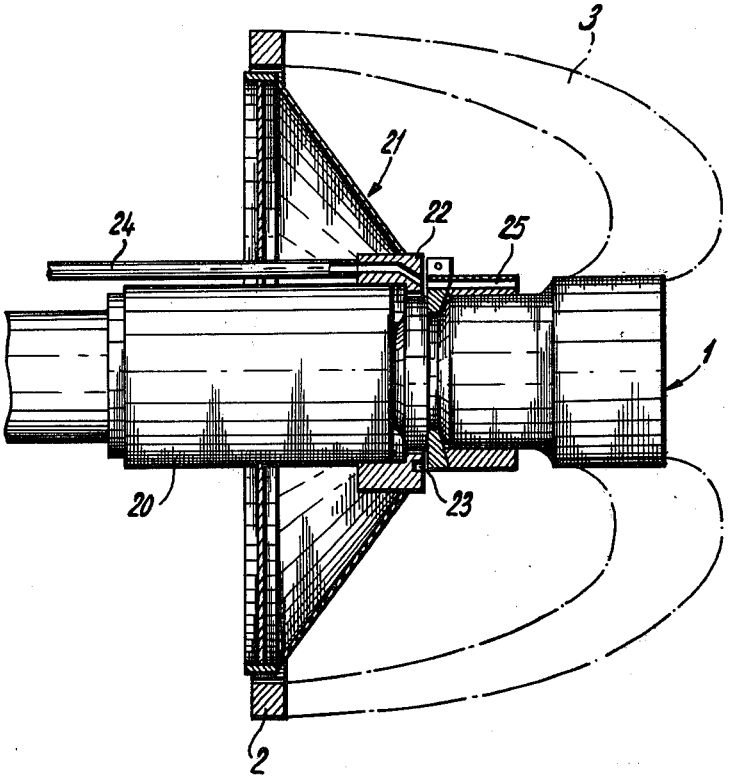
FIG. 5 is a diagrammatic side view of a cutter, and showing modified chambers for the supply of the fluid.

FIG. 5 is a side view of the cutter illustrated in FIGS. 1 and 2, in which the cutting blades 3 are only schematically shown. In the figures is also shown the bearing construction 20 for mounting the shaft which drives the hub 1 and a shield construction 21. An annular body 22 is provided on the bearing construction 20, an annular chamber 23 being formed in said annular body and said chamber 23 being divided into three sections by sealings in the same way as illustrated in FIG. 4. The chamber sections of the annular chamber 23, corresponding to the sections 15' and 15" illustrated in FIG. 4, can be brought into communication with a source for a fluid under pressure via pipe 24. Each one of the channels 4 provided in the cutting blades opens in a pipe 25 disposed along the hub 1 so that in the same way as described hereinabove for the cutter shown in FIGS. 3 and 4, the fluid under pressure will flow to the nozzles mounted on the cutting blades only through the channels 4 of those cutting blades 3 which perform the actual cutting action.

Alternatively (not shown) annular body 22 and annular chamber 23 could also be disposed at any location along the driving shaft outside the cutter in which case each one of the channels 4 provided in the cutting blades does not open in a pipe 25 as shown in FIG. 5, but in a channel or passage provided in the driving shaft and hub 1 and extending from annular chamber 23 to channel 4.

I claim:

1. A generally circular cutter head for a suction dredger having a plurality of helically and radially oriented cutting blades mounted thereon, said head being rotatably driven in operation such that said blades cut loose soil which , when mixed with water, is withdrawn by suction tube means, characterized by:

(a) at least one fluid ejecting nozzle disposed on each blade to the rear of a leading, cutting edge thereof relative to the direction of rotation of said cutter head, each nozzle being directed generally radially outwardly relative to a central hub of said cutter head such that a fluid jet emanating therefrom pretreats the soil portion to be cut loose by the next cutting blade, and (b) means for communicating a pressurized supply of fluid to said nozzles.

2. A cutter head as claimed in claim 1, wherein said means for communicating comprises a plurality of channels individually extending along the cutting blades, and at least one closed chamber in the form of a circular arc in which a stationary pipe for the supply of fluid opens and one wall of which is formed by an end face of a rotatable, substantially annular member to which the cutting blades are connected and through which member ends of the channels extend such that during rotation of the cutter head said channels communicate with said chamber.

* * * * *